United States Patent [19]

Fischer

[11] 4,413,809

[45] Nov. 8, 1983

[54] ANTI-FLASHBACK CUTTING TORCH

[76] Inventor: Robert A. Fischer, 1903 Ave. C., Katy, Tex. 77449

[21] Appl. No.: 423,363

[22] Filed: Sep. 24, 1982

[51] Int. Cl.[3] ..... B23K 7/00

[52] U.S. Cl. ..... 266/48

[58] Field of Search ..... 266/48

[56] References Cited

U.S. PATENT DOCUMENTS 4,022,441 5/1977 Turney ..... 266/48

4,030,710 6/1977 Turney ..... 266/48

*Primary Examiner*—W. Stallard

*Attorney, Agent, or Firm*—Fulbright & Jaworski

[57] ABSTRACT

In a cutting torch having a torch head, a body having a fuel inlet and an oxygen inlet, control means connected to the body for controlling the flow of fuel and oxygen, a preheat tube assembly and a cutting oxygen tube assembly connected between the body and the head, the improvement in the preheat tube assembly for preventing flashback. An inner tubular member, preferably of brass, has a straight through bore with a fluid tight seal at the torch head by being threaded into the torch head and sealed with an O-ring seal. The opposite end connects to the body having a seal making a gas tight connection around a fuel passageway. The inner bore acts as an oxygen mixing chamber with no restrictions or orifices and consists of a single size diameter hole lengthwise through the member. Intermediate of the member is a plurality of spaced holes drilled through the member between the fuel passageway and the oxygen bore to allow the flow of fuel to be aspirated into the inner oxygen mixing chamber bore and carried to the torch head.

2 Claims, 4 Drawing Figures

Fig. 1
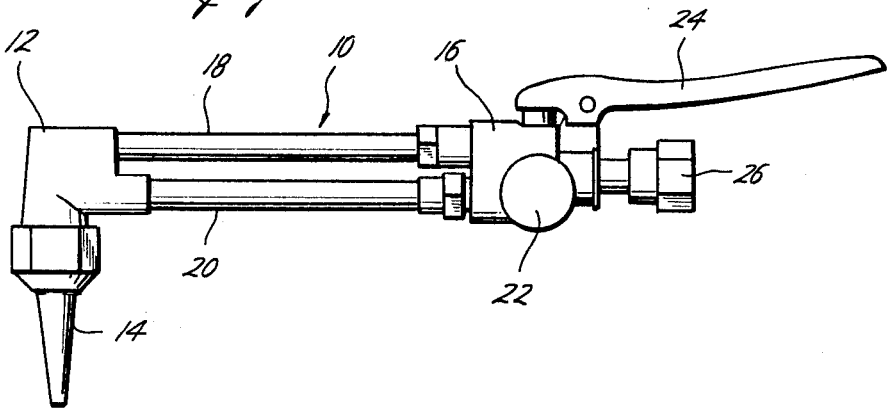
Fig. 2
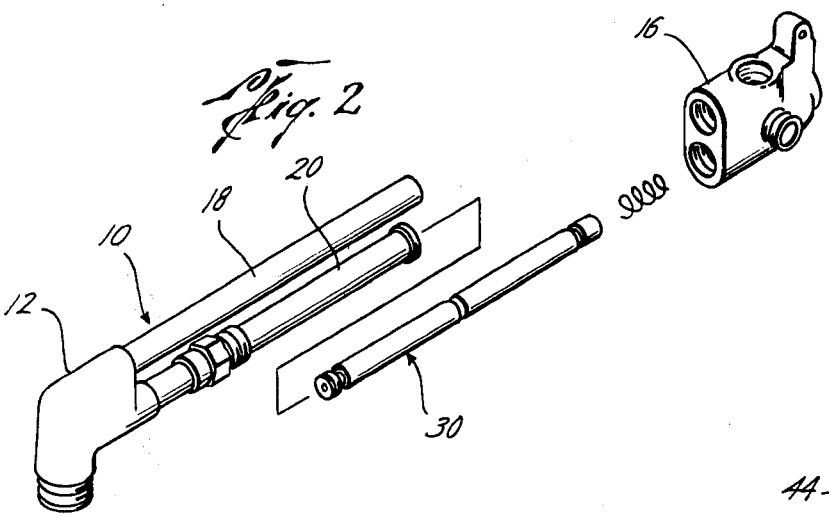
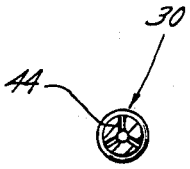
Fig. 4
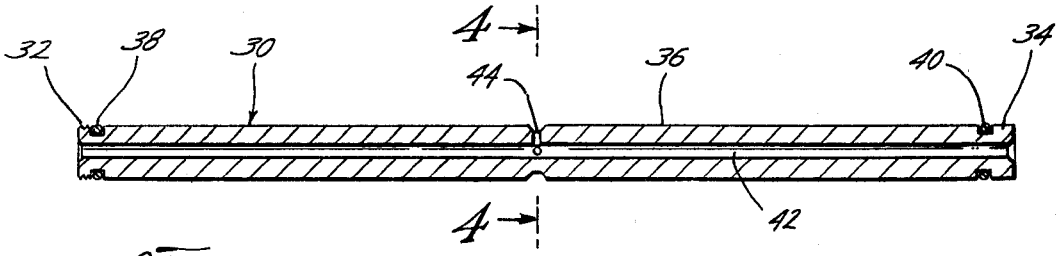
Fig. 3

ANTI-FLASHBACK CUTTING TORCH

BACKGROUND OF THE INVENTION

As discussed in U.S. Pat. No. 4,022,441 injector type cutting torches have always had a major drawback, that being the tendency to have sustained burning on flashback which could in fact burn up the torch. The prior art has utilized diffusers, frusto conical nose sections, spiral inserts and other mixers and orifices in order to avoid flashback.

The present invention is directed to an improvement for use in a cutting torch which provides a simple but effective way for reducing flashback and eliminates sustained burning caused by the flashbacks.

SUMMARY

It is an object of the present invention to provide an improvement for use in a conventional cutting torch for use in the preheat tube assembly for preventing flashback.

Still a further object of the present invention is to provide an inner oxygen mixing chamber tube for use in a preheat tube assembly which eliminates the need for diffusers with an injection type mixers, frusto conical nose sections, spiral inserts, and eliminates flashback.

Still a further object of the present invention is the provision of a specially designed inner oxygen mixing chamber tube with gas tight seals that eliminate flashback due to the constant pressure flow of oxygen through the tube without restriction whereby the oxygen is allowed to flow freely and aspirate the fuel without problems of flashback as it keeps the inner oxygen tube below the heat range that would allow combustion. By providing a steady flow of oxygen through the inner mixing chamber tube, the gaseous fuel surrounding the inner tube is not subject to combustion by heat transfer.

Still a further object of the present invention is the provision of an improvement in a cutting torch having a torch head, a body having a fuel inlet and an oxygen inlet, control means connected to the body for controlling the flow of fuel and oxygen, a preheat tube assembly and a cutting oxygen tube assembly connected between the body and the head. The improvement in the preheat assembly for preventing flashback includes an inner tubular member positioned in the preheat tube assembly in which the member is threadably connected at one end to the head and the outer surface of the tubular member is spaced from the inner surface of the preheat tube thereby forming a fuel passageway in communication with the fuel inlet. Seal means are provided at each end of the tubular member blocking the passageway ends. The tubular member has a straight through bore with the body end of the bore being in communication with the oxygen inlet. The member has one or more holes extending from the passageway to the bore intermediate the ends of the member for aspirating fuel from the passageway into the bore as oxygen flows through the bore to the head. Preferably, the bore is a uniform size throughout its length and may be of brass.

Other and further objects, features and advantages will be apparent from the following description of a presently preferred embodiment of the invention, given for the purpose of disclosure and taken in conjunction with the accompanying drawing.

BRIEF DESCRIPTION OF THE DRAWING

FIG. 1 is an elevational view of a cutting attachment for a conventional cutting apparatus, FIG. 2 is an isometric exploded view of a portion of the cutting attachment of FIG. 1, FIG. 3 is an enlarged elevational view, in cross section, of the oxygen mixing chamber and anti-flashback tube of FIG. 2, and FIG. 4 is a cross-sectional view taken along the line 4—4 of FIG. 3.

DESCRIPTION OF THE PREFERRED EMBODIMENT

While the present invention is useful in various types of cutting torches in providing an oxygen mixing chamber which will eliminate sustained burning on flashback, the present invention will be described, for purposes of illustration only, as used in a model CA1350 cutting attachment of Victor Equipment Company.

Referring now to FIGS. 1 and 2, the reference numeral 10 generally indicates a cutting attachment having a head 12, a tip 14, connected thereto and a body 16. A cutting oxygen tube 18 is connected between the torch head 12 and the body 16. A preheat tube assembly 20 is also connected between the torch head 12 and the body 16.

The body 16 includes an oxygen flow control valve 22 and a cutting oxygen flow control valve 24. In addition, the body 16 includes a fuel and an oxygen inlet 26. The body 16 conventionally includes passageways whereby the control of the cutting oxygen flow control valve 24 opens and closes to supply oxygen through the cutting oxygen tube 18 to the torch head 12 and torch tip 14. Both fuel and oxygen is supplied from the body 16 to the preheat tube assembly 20.

The above description of a cutting attachment is conventional. However, as indicated in U.S. Pat. No. 4,022,441, sustained burning on flashback has been a long time problem in cutting torches. Various types of structures have been proposed such as diffusers, injection type mixers, frusto conical nose sections, and spiral inserts, but they have only had limited success in controlling flashback.

The present invention is directed to an inner oxygen mixing chamber tube which is positioned in the preheat tube 20 for mixing oxygen and fuel but eliminates flashback. Referring to FIGS. 2 and 3, an inner tubular member 30 is provided positioned in the preheat tube assembly 20. The tubular member 30 includes threads 32 at one end for threading into the torch head 12. The second end 34 extends into the body 16. The outer surface 36 of the tubular member 30 is sized to be spaced from the inner surface of the preheat tube 20 thereby forming a fuel passageway between the interior surface of the tube 20 and the outer surface 36 of the member 30. Seal means such as O-rings 38 and 40 are provided at each end of the tubular member 30 forming the ends of the passageway between the exterior 36 and the inner surface of the tube 20. The formed passageway is in communication with the fuel passageway in the body 16. The member 30 has a straight through bore 42 which communicates oxygen from the body 16 to the torch head 12.

One or more holes 44, preferably three, are provided in the tubular member 30 extending from the exterior 36 and thus from the fuel passageway, to the bore 42 intermediate of the ends of the member 30. Thus, as oxygen flows through the bore 42 it will aspirate fuel from the passageway at the outer surface 36 of the member 30 into the holes 44 and to the head 12. Thus, the bore 42 acts as a mixing chamber which mixes and carries the fuel and oxygen to the torch head 12 to be dispensed through the tip 14.

In operation, oxygen is continuously flowed through the bore 42. Since there are no restrictions in the bore 42 the oxygen will flow freely and aspirate the gaseous fuel. With the threaded connection and seals 38 and 40 the fuel is removed from any flashback. The flow of oxygen through the bore 42 keeps the temperature of the tubular member 30 below the heat range that would create combustion. Thus, the steady flow of oxygen through the bore 42 keeps the gaseous fuels on the exterior surface 36 of the tube 30 from being subject to flashback.

The design of the oxygen mixing chamber tube 30 is also advantageous due to its simple design and economical cost of manufacturing. The present apparatus is much simpler than the prior art structures. In addition, in actual tests the present invention has effectively eliminated flashbacks.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a cutting torch having a torch head, a body having a fuel inlet and oxygen inlet, control means connected to the body for controlling the flow of fuel and oxygen, a preheat tube assembly and a cutting oxygen tube assembly connected between the body and the head, the improvement in the preheat tube assembly for preventing flashback comprising, an inner tubular member positioned in the preheat tube assembly, said member being threadably connected at one end to the head, the outer surface of the tubular member spaced from the inner surface of the preheat tube forming a fuel passageway in communication with the fuel, said means at each end of the tubular member blocking said passageway ends, said tubular member having a straight through bore with the body end of the bore being in communication with the oxygen, said member having one or more holes extending from the passageway to the bore intermediate the ends of the member for aspirating fuel from the passageway into the bore as oxygen flows through the bore to the head.

2. The apparatus of claim 1 wherein the bore is a uniform size throughout its length.

* * * * *